United States Patent [19]

Knodel et al.

[11] Patent Number: 4,754,610

[45] Date of Patent: Jul. 5, 1988

[54] APPARATUS AND METHOD OF ICE PRODUCTION BY DIRECT REFRIGERANT CONTACT WITH AQUEOUS LIQUID

[75] Inventors: Bryan D. Knodel, Plainfield; Joseph A. Costenero, Woodridge, both of Ill.

[73] Assignee: Chicago Bridge & Iron Company, Oak Brook, Ill.

[21] Appl. No.: 853,217

[22] Filed: Apr. 17, 1986

Related U.S. Application Data

[63] Continuation-in-part of Ser. No. 727,537, Apr. 26, 1985, abandoned.

[51] Int. Cl.[4] ..... F25C 1/00

[52] U.S. Cl. ..... 62/74; 62/347

[58] Field of Search ..... 62/48, 69, 70, 123, 62/47, 76, 384, 347, 74, 534, 330, 64, 63, 65, 60

[56] References Cited

U.S. PATENT DOCUMENTS

| | | | |
|---|---|---|---|
| 3,017,751 | 1/1962 | Hawkins | 62/58 |
| 3,017,752 | 1/1962 | Findlay | 62/58 |
| 3,259,181 | 7/1966 | Ashley et al. | 165/107 |
| 3,835,658 | 9/1974 | Wilson | 62/58 |
| 3,885,399 | 5/1975 | Campbell | 62/123 |
| 3,933,001 | 1/1976 | Muska | 62/47 |
| 4,036,619 | 7/1977 | Ganiaris | 62/123 |
| 4,046,534 | 9/1977 | Maguire | 62/534 |
| 4,286,436 | 9/1981 | Engdahl et al. | 62/532 |

FOREIGN PATENT DOCUMENTS

| | | | |
|---|---|---|---|
| 2147880 | 3/1972 | Fed. Rep. of Germany | 62/70 |
| 1371027 | 10/1984 | United Kingdom . | |

*Primary Examiner*—Henry A. Bennet

*Attorney, Agent, or Firm*—Marshall, O'Toole, Gerstein, Murray & Bicknell

[57] ABSTRACT

A method of producing ice while substantially reducing encapsulation of refrigerant in the ice by feeding a liquefied refrigerant in the form of a jet of very fine droplets to an aqueous body whereby the liquefied refrigerant is very rapidly vaporized and ice is produced, by transfer of heat from the adjacent water to the refrigerant, without encapsulating any significant amount of refrigerant in the ice. The refrigerant within the feeding device is desirably at a temperature above the freezing point of the aqueous body so as to prevent ice from forming on refrigerant feeding devices and blocking outlet orifices therein. Apparatus for producing ice in an aqueous body comprising a closed vessel for holding an aqueous body; a device for feeding a liquefied refrigerant in the form of very fine droplets to an aqueous body in the vessel; a conduit for feeding an aqueous liquid into the vessel; and a conduit for withdrawing an aqueous ice slurry and refrigerant vapor from the vessel.

10 Claims, 2 Drawing Sheets

APPARATUS AND METHOD OF ICE PRODUCTION BY DIRECT REFRIGERANT CONTACT WITH AQUEOUS LIQUID

This application is a continuation-in-part of our copending U.S. patent application Ser. No. 727,537 filed Apr. 26, 1985 now abandoned.

This invention relates to apparatus and methods of producing ice from aqueous liquids. More particularly, this invention is concerned with apparatus and methods of producing ice by directly contacting an aqueous liquid with a refrigerant.

BACKGROUND OF THE INVENTION

The production of ice in aqueous liquids has many useful purposes. Thus, ice can be produced and used immediately, or the ice can be stored and used later, for cooling purposes. Also, in the production of potable water, sea water and brackish water can be cooled to produce ice, the ice separated and then melted to give the desired fresh water. Fruit and vegetable juices are also concentrated by cooling them to produce ice and then separating the ice from the concentrated juice.

The production of ice for the described purposes, as well as others, can be achieved in a number of ways including indirect heat transfer in a shell and tube freeze exchanger. A refrigerant can be used as the cooling medium on the shell side of the freeze exchanger. This method is disclosed in U.S. Pat. No. 4,286,436.

Another method of producing ice is to directly contact the aqueous liquid with a refrigerant. Direct contact heat transfer requires a reduced temperature difference between the vaporizing refrigerant and freezing solution than does indirect heat transfer systems to achieve the same energy transfer due to the elimination of the heat exchanger surface. However, the exact temperature difference required in the direct contact heat exchanger will depend upon several factors including the properties of the two fluids, the ratio of the two fluids and agitation. This method, as well as apparatus useful therefore, is disclosed in U.S. Pat. Nos. 3,017,751; 3,017,752; 3,259,181; 3,835,658; 3,885,399 and 4,046,534. After the ice is produced it is separated and then discarded, melted and used as potable water or melted to recover stored refrigeration. The refrigerant used for cooling and ice formation is recovered to the extent possible and then reused in the process.

Experience has shown that the refrigerant feeding device used for feeding the refrigerant into the aqueous liquid body has a tendency to clog due to the formation of ice on and around the feeding device and orifice through which the refrigerant flows and expands. To prevent these ice formations it has been proposed to apply resistant heating to the refrigerant feeding device as shown in U.S. Pat. No. 3,672,182. The use of resistance heating represents a persistent energy consumption. Accordingly, it would be desirable in the production of ice, by directly contacting an aqueous liquid with a refrigerant, if the refrigerant feeding device could be maintained free of ice without the use of additional energy.

Experience has also shown that a significant amount of refrigerant is lost in direct contact methods because refrigerant vapor and liquid is encapsulated or entrapped in the ice crystals. When the ice is later melted or disposed of, some or most of the encapsulated refrigerant is lost. Additionally, encapsulation of the refrigerant constitutes an economic loss of potential cooling capacity which would otherwise produce additional ice. Accordingly, it would be desirable in the production of ice, by directly contacting an aqueous liquid with a refrigerant, if refrigerant encapsulation in the ice could be reduced and even substantially eliminated.

The subject invention provides means for preventing ice formation on refrigerant feeding devices and preventing or reducing encapsulation of refrigerant in the ice.

SUMMARY OF THE INVENTION

According to one aspect of the invention there is provided a method of producing ice while substantially reducing encapsulation of refrigerant in the ice, comprising feeding a liquefied refrigerant in the form of a jet stream of very fine droplets to an aqueous liquid body whereby the liquefied refrigerant is very rapidly vaporized and ice is produced, by transfer of heat from the adjacent water to the refrigerant, without encapsulating any significant amount of refrigerant in the ice. The vast increase in refrigerant surface area exposed to the water, the significant velocity of the droplets, as well as the decrease in volume of a given droplet, combine to produce very rapid heat transfer. The accelerated heat transfer allows each refrigerant droplet to vaporize without being trapped in an ice crystal.

According to another aspect of the invention there is provided a method of producing ice while substantially eliminating ice formation on a refrigerant feeding device and blockage of the outlet orifice thereof comprising feeding a liquefied refrigerant in the form of a high pressure warm liquid stream into a refrigerant feeding device, whereby the warm liquefied refrigerant keeps the device warm and keeps ice from depositing on the device, and the liquefied refrigerant is expanded as it passes out thereof in the form of very fine droplets and then feeding the droplets to an aqueous liquid body, and the liquefied refrigerant droplets are very rapidly vaporized and ice is produced by transfer of heat from the adjacent water to the refrigerant.

Although the liquefied warm refrigerant is expanded as it passes through the device and its temperature drops before it is introduced into the aqueous liquid the refrigerant is then outside of the device and cannot reduce the temperature of the device, thus eliminating ice formation on the device surface. By liquefied warm refrigerant is meant a liquefied refrigerant which is at least slightly above the freezing point of the aqueous liquid body from which ice is to be produced. Generally, the liquefied refrigerant will be at or above 32° F., but usually will not be above 150° F., as it is fed into the refrigerant feeding device.

It is to be understood that by using a warm liquefied refrigerant to substantially prevent ice from depositing on the device external surface and blocking its exit orifice, a jet stream of cold expanded refrigerant is produced which cools the aqueous liquid body and produces ice particles with little encapsulation of refrigerant in the ice particles.

The liquefied refrigerant can be fed into the aqueous body through a feeding device such as a nozzle, a perforated tube having holes therein or other suitable means. Desirably, a means is used which provides the refrigerant droplets such that they have an average droplet size up to approximately 500 microns, and often not larger than 100 microns.

The refrigerant droplets can be introduced into the water beneath its surface. Alternatively, the refrigerant droplets can be directed to the surface of the body of water at a velocity sufficient to penetrate the water surface.

The body of water can be located in a vertical chamber and the liquefied refrigerant fed into the water at the bottom so that the resulting four phase dispersion of refrigerant vapor, water, ice crystals and liquefied refrigerant droplets is self agitated by the swirling churning action of the flow.

According to a further aspect of the invention apparatus for producing ice in an aqueous body is provided comprising a closed vessel for holding an aqueous body; means for feeding a liquefied refrigerant in the form of very fine droplets desirably having an average droplet size up to approximately 500 microns, to an aqueous body in the vessel; means for feeding an aqueous liquid into the vessel; and means for withdrawing an aqueous ice slurry and refrigerant vapor from the vessel.

The apparatus can have means for withdrawing aqueous liquid, liquefied refrigerant and vapor and ice from the vessel as a single stream for separation of the components elsewhere. However, the vessel can have means for withdrawing primarily only refrigerant vapor.

The device for feeding liquefied refrigerant to the aqueous body in the vessel can include a nozzle, a perforated tube or other suitable means from which the droplets are sprayed or flow into the aqueous body from either above or below the aqueous body surface.

The vessel can be sized to contain the aqueous body as a vertical column and the device for feeding the liquefied refrigerant to the aqueous body can be positioned to feed the liquefied refrigerant into the bottom portion of the aqueous column.

The vessel also can be sized and shaped to contain a horizontal aqueous body and the described device for feeding the liquefied refrigerant into the aqueous body can be positioned to feed the liquefied refrigerant onto and below the surface of the aqueous body.

The apparatus can have an agitator located in the vessel to agitate the aqueous body.

Refrigerants particularly useful in the invention are those which do not form hydrates or react with the aqueous body. Some specific refrigerants which can be used are propane, butane, isobutane, octafluorocyclobutane, dichlorotetrafluoroethane (R-114), and a mixture of R-114 and dichlorodifluoromethane (R-12) where less than 40% by weight of the mixture is R-12. Refrigerants, such as R-114, which are liquid at a warm temperature and increased pressure are particularly useful since they prevent formation of ice on the refrigerant feeding device as already explained above.

DETAILED DESCRIPTION OF THE DRAWINGS

To the extent it is reasonable and practical, the same elements or parts which appear in the various views of the drawings will be identified by the same numbers.

Figure 1:
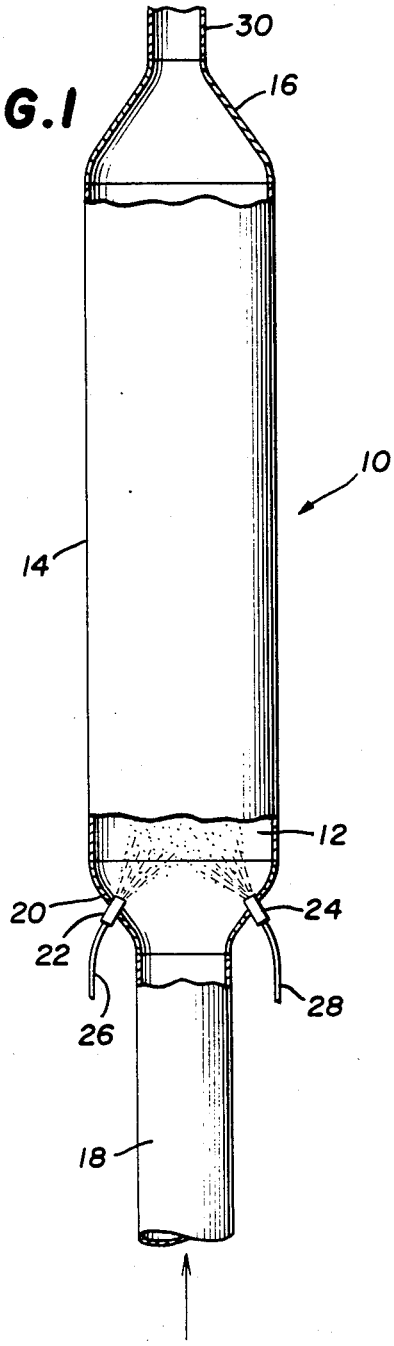
FIG. 1 is an elevational view, partially broken away, of a vertical closed vessel having a pair of nozzles for feeding droplets of a liquefied refrigerant gas into an aqueous body in the vessel.

With reference to FIG. 1, the closed vessel 10 for holding an aqueous body or volume 12 has a vertical tubular shell 14 and a top transition section 16 which communicates with outlet conduit 30. Vertically positioned inlet conduit 18 communicates through transition section 20 with the lower end of the shell 14. The aqueous liquid which forms aqueous body 12 is supplied to shell 14 through lower conduit portion 18. A pair of nozzles 22,24 are mounted in the transition section 20. Nozzles suitable for use in the apparatus can be obtained from Spraying Systems Co., Wheaton, Illinois. Conduit 26 supplies liquefied refrigerant gas to nozzle 22 and conduit 28 supplies liquefied refrigerant gas to nozzle 24.

The refrigerant flows from the nozzles 22,24 in the form of droplets having an average size up to approximately 500 microns in diameter. As a result, very rapid efficient heat transfer takes place with formation of ice crystals in the aqueous liquid. Entrapment of refrigerant vapor and liquid is, as a consequence, essentially avoided.

A mixture of aqueous liquid, ice crystals and refrigerant vapor are fed from inside shell 14 through outlet 30. This mixture is then fed to a tank, or other suitable means, where separation of the ice, refrigerant and aqueous liquid can be effected. Following such separation some or all of the aqueous liquid can be recycled to vessel 10 to convert more of it to ice in the described way.

Figure 2:
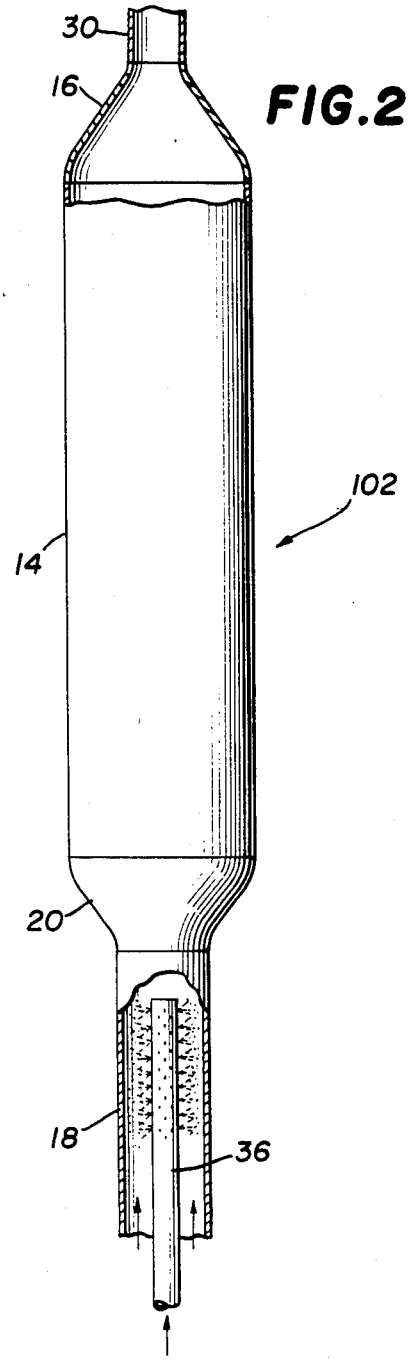
FIG. 2 is similar to FIG. 1 but it shows use of a perforated tube for feeding refrigerant droplets into the aqueous body.

The closed vessel 102 shown in FIG. 2 is very similar to the vessel 10 shown in FIG. 1. However, vessel 102 is not provided with nozzles 22,24. Instead, vessel 102 has a perforated tube 36 axially located in lower portion 18. Refrigerant supplied to tube 36 flows through the holes in tube 36 in the form of droplets, having an average size up to approximately 500 microns in diameter, into aqueous liquid flowing upwardly through lower portion 18. The droplets which flow out through the holes in tube 36, being very small, very rapidly disperse in the aqueous liquid with efficient heat transfer and formation of ice crystals which entrap essentially no, or very little, refrigerant vapor or liquid. The resulting mixture of aqueous liquid, ice crystals and refrigerant vapor are withdrawn from vessel 102 through conduit 30 and transported to a destination for separation of the components.

The perforated tube 36 can be a tube made of a suitable polymeric material, such as polypropylene, high-density polyethylene, polyvinylidene flouride, ethylene vinyl acetate, styrene acrylonitrile, polytetrafluoroethylene, a rigid polyvinyl chloride, or chlorinated polyvinyl chloride. The tube can be provided with holes of suitable size and number.

Figure 3:
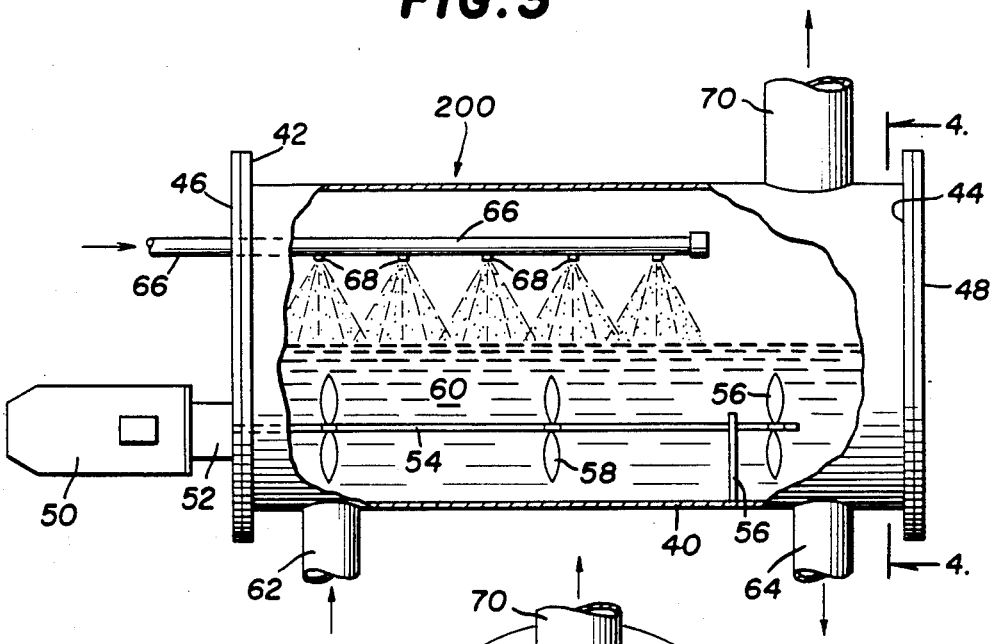
FIG. 3 is a side elevational view, partially broken away, of a horizontal enclosed vessel containing a horizontal aqueous body and nozzles for feeding refrigerant droplets into the aqueous body.
Figure 4:
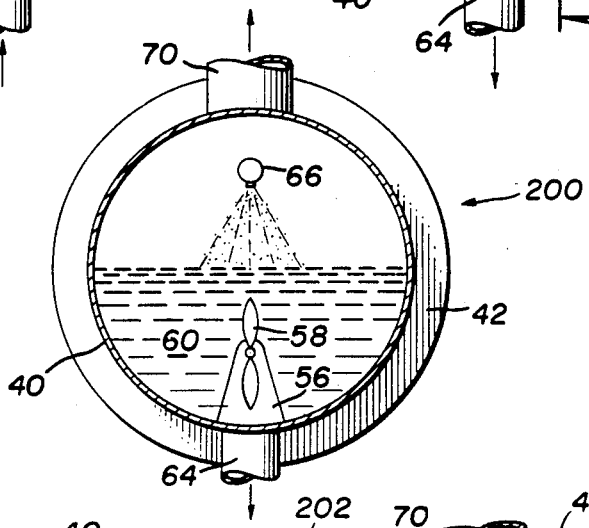
FIG. 4 is a sectional view taken along the line 4—4 of FIG. 3.

A further embodiment of the invention is illustrated by FIGS. 3 and 4. Horizontal enclosed vessel 200 has a cylindrical circular horizontal shell 40 with lateral ringlike flanges 42,44 at each end. Removable circular flat plate 46 is attached by means, not shown, to flange 42. Similarly, removable circular flat plate 48 is attached by means, not shown, to flange 44.

Electric motor 50 is in operative engagement with variable speed transmission 52 mounted on the outside of plate 46. Shaft 54 extends horizontally from transmission 52 into the lower portion of vessel 200. The inner end of shaft 54 is supported by bracket 56. Stirring blades 58 are mounted on shaft 54 to agitate the aqueous body 60 in the vessel.

Conduit 62 communicates with the lower portion of vessel 200 and provides means for feeding aqueous liquid into the vessel. Conduit 64 also communicates with the lower portion of vessel 200 but it provides means for withdrawing a mixture of aqueous liquid and ice crystals.

Horizontal pipe 66 extends through end plate 46 into the upper portion of vessel 200 and provides a means for delivering a liquefied refrigerant gas into the vessel. A plurality of nozzles 68 are mounted on the bottom of pipe 66 so as to direct a spray of refrigerant droplets on and into the liquid body 60 in the vessel 200. The droplets have an average size up to approximately 500 microns, and often not larger than 100 microns, in diameter. The velocity of the droplets forming the spray propels them into and below the surface of the water in the vessel. The resulting rapid heat exchange causes the water to cool and ice crystals to form with little or no refrigerant vapor or liquid entrapment in the crystals.

The resulting heat exchange converts the refrigerant liquid to vapor which accumulates in the upper internal space in vessel 200. The refrigerant vapor, and some water vapor, can be withdrawn from the vessel through conduit 70 and processed so that the refrigerant can be recycled and used again.

Figure 5:
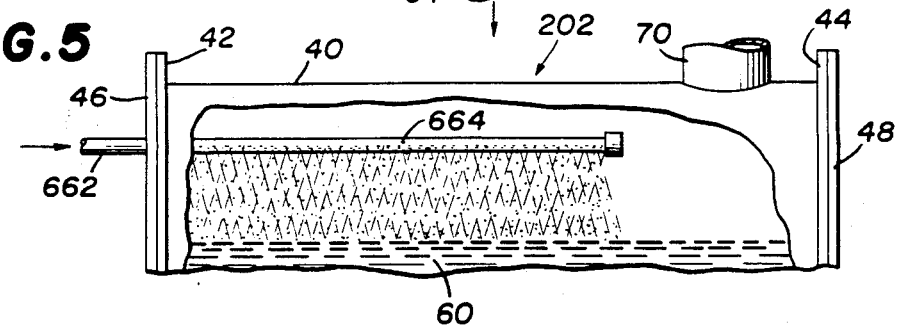
FIG. 5 is a partial view of the apparatus shown in FIG. 3 but with a perforated tube replacing the nozzles for feeding refrigerant droplets to the horizontal aqueous body.

FIG. 5 illustrates another embodiment of the ivention which, however, employs apparatus as shown in FIGS. 3 and 4. In this embodiment, refrigerant supply pipe 662 communicates with perforated tube 664 in the form of a tubular member. The refrigerant flowing through the holes in tube 664 exits as a spray of very small droplets, having an average size up to approximately 500 microns in diameter, at a high velocity. The droplets are propelled to and beneath the surface of the aqueous body 60 in the vessel 202. Rapid heat exchange takes place and ice crystals are formed containing very little, if any entrapped refrigerant vapor or liquid. The mixture of ice crystals and aqueous liquid can be withdrawn by conduit 64 as shown in FIG. 3 and refrigerant vapor can be removed by conduit 70.

It is considered desirable to feed a high pressure warm liquefied refrigerant in all of the apparatus illustrated by the drawings. Thus, the refrigerant fed to the nozzle or perforated tube should be at a temperature of at least 32° F., and above the freezing point of the aqueous liquid body, so as to prevent ice from depositing on the refrigerant supply device and blocking the orifice(s). The liquefied refrigerant is expanded as it passes out of the feeding device producing a jet stream of cold refrigerant which cools the aqueous liquid body and produces ice particles.

EXAMPLE

An apparatus of the type illustrated by FIG. 3 is sized to provide 10 tons of refrigeration (120,000 BTU/hr.) The vessel contains water and the refrigerant, dichlorotetrafluoroethane (R-114), is atomized as droplets having a size up to approximately 500 microns in diameter into the water which is at 32.3° F. The liquid refrigerant is at 42.23 psia and 95° F. and thus is warm.

As the refrigerant immerges from the nozzles it is flashed to 11.36 psia and 27° F. with 27.1% by weight vaporized during the flash.

The relatively high velocity flow of atomized refrigerant is directed into the water where a portion of the water is frozen into ice crystals essentially free of encapsulated refrigerant, which vaporizes. The vaporized refrigerant is withdrawn from the vessel at 11.36 psia, 31° F. and 4° F. superheat. Since the refrigerant is warm when fed to the nozzle inlet, ice does not deposit on and block the nozzle.

A mixture of ice and water (10% ice) is continuously removed from the vessel. It is desirable to convert a relatively high amount of the water to ice crystals (5–15%) during a single pass through the vessel to minimize pumping horsepower requirements while maintaining good pumping characteristics.

The foregoing detailed description has been given for clearness of understanding only, and no unnecessary limitations should be understood therefrom, as modifications will be obvious to those skilled in the art.

What is claimed is:

1. A method of producing ice while substantially reducing encapsulation of refrigerant in the ice, comprising:

feeding a liquefied refrigerant in the form of very fine droplets to an aqueous body through a refrigerant feeding device having an outlet orifice, the refrigerant being at a temperature above the freezing point of the aqueous body when fed to the feeding device, while the liquefied refrigerant is very rapidly vaporized and ice is produced, by transfer of heat from the adjacent water to the refrigerant, without encapsulating any significant amount of refrigerant in the ice.

2. A method according to claim 1 in which the liquefied refrigerant is fed into the aqueous body through a nozzle or a perforated tube.

3. A method according to claim 1 in which the aqueous body is in a chamber and the liquefied refrigerant is fed into the water so that the resulting four phase dispersion of refrigerant vapor, water, ice crystals and liquefied refrigerant droplets is self agitated by the swirling churning action of the flow.

4. A method according to claim 1 in which the refrigerant droplets are introduced into the aqueous body beneath its surface.

5. A method according to claim 1 in which the refrigerant droplets are directed to the surface of the aqueous body at a velocity sufficient to penetrate the water surface.

6. A method of producing ice while substantially eliminating ice formation on a refrigerant feeding device comprising:

feeding a stream of a high pressure warm liquefied refrigerant into a refrigerant feeding device and expanding it therefrom in the form of a jet of very fine cold droplets and feeding the droplets to an aqueous liquid body whereby the warm liquefied refrigerant keeps the feeding device warm and keeps ice from depositing on the feeding device, and the liquefied refrigerant droplets are very rapidly vaporized and ice is produced by transfer of heat from the adjacent water to the refrigerant.

7. A method according to claim 6 in which the liquefied refrigerant within the feeding device is at a temperature at least slightly above the freezing point of the aqueous liquid body.

8. A method according to claim 7 in which the liquefied refrigerant is at a temperature above 32° F. as it is fed into the feeding device.

9. A method according to claim 6 in which the refrigerant is dichlorotetrafluoroethane and it is at about 95° F. as it flows into the feeding device.

10. A method according to claim 1 in which the warm refrigerant is at a temperature of at least 32° F.

* * * * *